US006550544B1

(12) United States Patent
Saf

(10) Patent No.: US 6,550,544 B1
(45) Date of Patent: Apr. 22, 2003

(54) ROCK DRILLING DEVICE

(75) Inventor: Fredrik Saf, Vintrosa (SE)

(73) Assignee: Atlas Copco Rock Drills AB, Orebro (SE)

( * ) Notice: Subject to any disclaimer, the term of this patent is extended or adjusted under 35 U.S.C. 154(b) by 0 days.

(21) Appl. No.: 09/786,107

(22) PCT Filed: Aug. 18, 1999

(86) PCT No.: PCT/SE99/01389

§ 371 (c)(1),
(2), (4) Date: Feb. 27, 2001

(87) PCT Pub. No.: WO00/14376

PCT Pub. Date: Mar. 16, 2000

(51) Int. Cl.[7] ..... E21B 1/02

(52) U.S. Cl. ..... 173/4; 173/4; 173/6; 173/9; 173/20; 173/21; 173/35

(58) Field of Search ..... 173/4, 11, 19, 173/6, 9, 15, 36, 35, 34, 32, 20, 21

(56) References Cited

U.S. PATENT DOCUMENTS 3,613,804 A * 10/1971 Jonsson ..... 173/147
4,461,015 A 7/1984 Kulhavy
4,537,263 A * 8/1985 Bjor ..... 173/1
5,343,962 A * 9/1994 Daigle et al. ..... 173/141
5,351,531 A 10/1994 Kerr
5,601,148 A * 2/1997 Heiskanen et al. ..... 173/147
6,016,878 A * 1/2000 Jansson ..... 173/6
6,094,910 A * 8/2000 Vatne ..... 60/416

FOREIGN PATENT DOCUMENTS

WO 9406999 3/1994

* cited by examiner

*Primary Examiner*—Rinaldi I. Rada
*Assistant Examiner*—Gloria R Weeks
(74) *Attorney, Agent, or Firm*—Mark P. Stone

(57) ABSTRACT

A rock drilling device has a feed beam (1) and a rock drilling machine (2) movable along the feed beam. The rock drilling machine is fed along the feed beam (1) by a feed line (7), which is routed over a sheave (6) arranged at the movable end (5) of a pressure medium cylinder (3). A further line (8) is arranged between two points (9, 10) which are fixed relative to the movable end of the pressure medium cylinder. The further line (8) is connected to a measuring device (11) which is fixed to the feed beam (1) for measuring displacement of the rock drilling machine (2) along the feed beam.

1 Claim, 1 Drawing Sheet

ROCK DRILLING DEVICE

BACKGROUND OF THE INVENTION

The present invention relates to a rock drilling device. More particularly the invention relates to a rock drilling device provided with a measuring device for measuring the movement of a rock drilling machine along a feed beam.

In a previously known device of the above mentioned kind, see WO 94/06999, FIG. 4, the movement of the rock drilling machine along the feed beam is sensed by a measuring means which is arranged on the rock drilling machine. A drawback with this device is that the measuring means moves with the rock drilling machine in its movement along the feed beam. The measuring cables therefore must be lead away via the usual hose reel. This means that the measuring cables must be placed among the pressure medium conduits which supply driving medium to the rock drilling machine. Since these conduits contain fluid of pulsating pressure the conduits will vibrate which can damage the measuring cables.

SUMMARY OF THE INVENTION

The present invention, which is defined in the subsequent claim, aims at achieving a rock drilling device where the above mentioned problems with damages on the measuring cables are avoided through arranging the measuring device stationary on the feed beam, through which the measuring cables need not be arranged together with the pressure medium conduits.

BRIEF DESCRIPTION OF THE DRAWINGS

An embodiment of the invention is described below with reference to the accompanying drawing in which.

BRIEF DESCRIPTION OF THE BEST MODES FOR CARRYING OUT THE INVENTION

Figure 1:
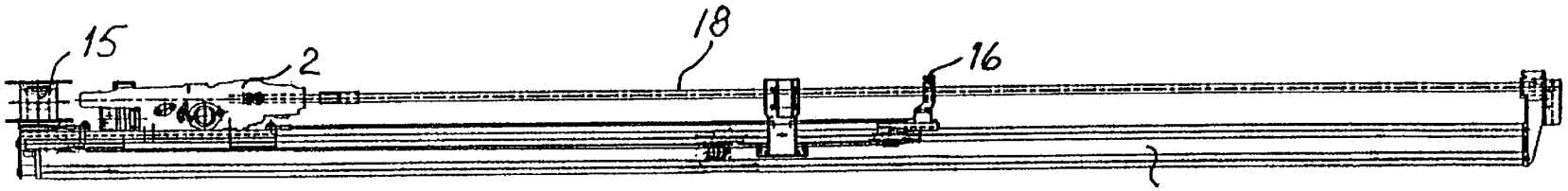
FIG. 1 shows a rock drilling device according to the invention.
Figure 2:
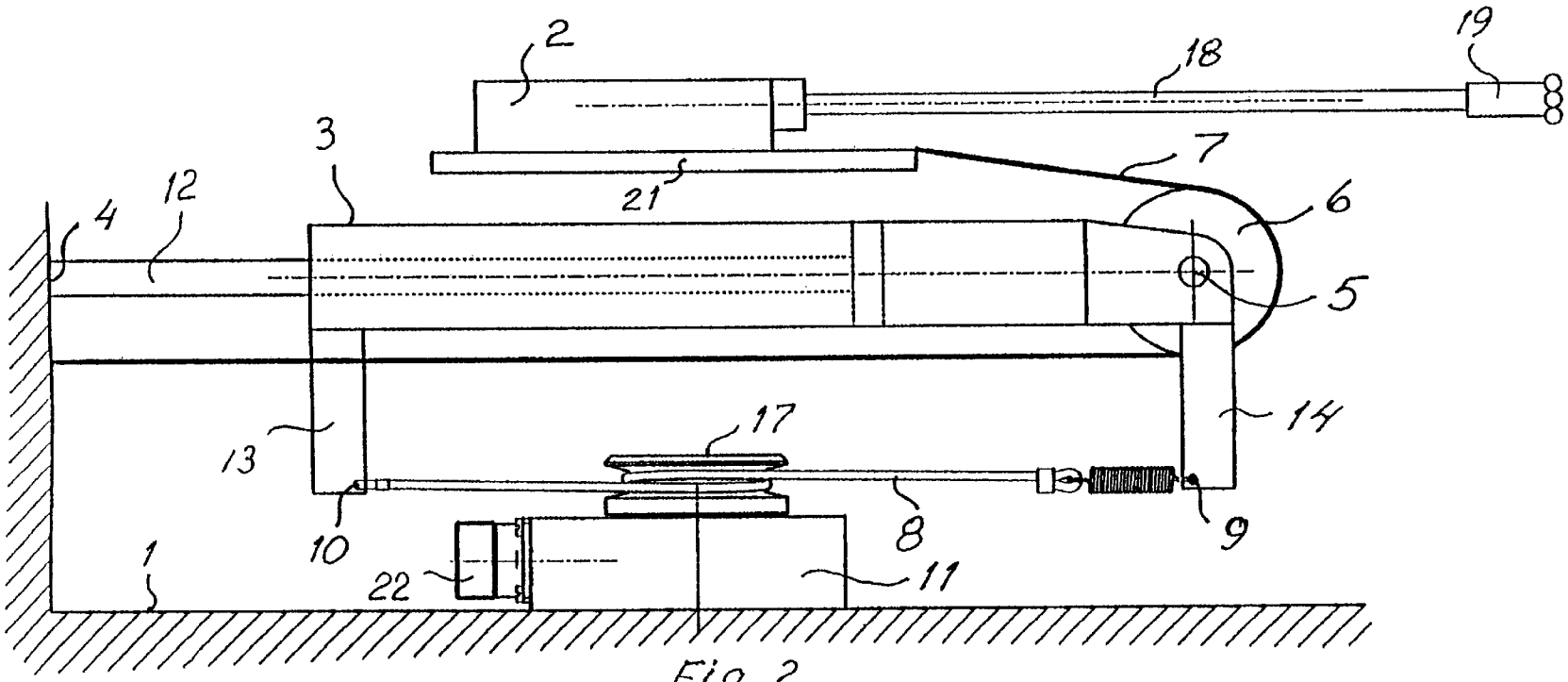
FIG. 2 shows schematically a part of the device according to FIG. 1 with certain parts taken away for increased clarity.

The device shown in the drawing comprises a feed beam 1 intended to be carried by a not shown drill rig in the usual manner. A rock drilling machine 2 is arranged on a slide 21 which is movable along the feed beam 1. A drill string 18 including a drill bit 19 is connected to the rock drilling machine 2. The rock drilling machine is displaced by means of a pressure medium cylinder 3 and a feed line 7. In practice, not shown in FIG. 2, there is also a feed line for the return feed of the rock drilling machine. The pressure medium cylinder 3 has a first end 4 which is fixed relative to the feed beam 1 and a second end 5 which is movable relative to the feed beam 1. In the shown example it is the piston rod 12 of the pressure medium cylinder 3 which is fixed relative to the feed beam 1. It is also possible to turn the pressure medium cylinder 3 such that the movable end 5 is arranged on the piston rod 12. The movable end 5 of the pressure medium cylinder 3 carries a sheave 6. The feed line 7 which is routed over the sheave 6 is with its one end fixed to the feed beam 1 and with its other end connected with the slide 21 of the rock drilling machine 2. With this arrangement the rock drilling machine 2 is driven along the feed beam 1 with twice as high speed as the movable end 5 on the pressure medium cylinder 3. The rock drilling device is provided with a hose reel 15 and a drill support 16 at the middle of the drill string 18. The hose reel 15 is in FIG. 2 marked by the support 13 and the drill support 16 by the support 14. This means that the hose reel 15 and the drill support 16 are driven along the feed beam 1 with the same speed as the movable end 5 of the pressure medium cylinder 3 in the usual way. The supports 13,14 are provided with points 9,10 between which a further line 8 is arranged. This further line is routed, one or more turns, about a wheel 17 on a measuring device 11 which is fixed on the feed beam 1. The measuring device 11 delivers pulses corresponding to the displacement of the rock drilling machine 2 along the feed beam 1. Since the measuring cables are connected to a socket 22 on the measuring device 11 the measuring cables are fixed relative to the feed beam 1 and are thus not exerted to the loads which vibrating pressure medium hoses cause. The position of the rock drilling machine 2 along the feed beam 1 is measured by counting the pulses from the measuring device 11.

What is claimed is:

1. Rock drilling device comprising a feed beam (1), a rock drilling machine movable to-and-fro along the feed beam, a pressure medium cylinder (3) of which one end (4) is fixed relative to the feed beam (1) and the other end (5) is movable relative to the feed beam and carries a sheave (6) over which a feed line (7) is routed, said feed line (7) being connected with the feed beam (1) and with the rock drilling machine (2) for feeding the rock drilling machine along the feed beam, characterized in that a further line (8) is arranged between two points (9, 10) which are fixed relative to the movable end (5) of the pressure medium cylinder (3), and that said further line (8) is connected with a measuring device (11) which is fixedly arranged on the feed beam (1).

* * * * *